US007611139B2

(12) United States Patent
Purcell et al.

(10) Patent No.: US 7,611,139 B2
(45) Date of Patent: Nov. 3, 2009

(54) ITEM TRANSPORT WITH SINGULATION DETECTION

(75) Inventors: David W. Purcell, New Milford, CT (US); Steven J. DaCunha, West Hartford, CT (US); Richard F. Stengl, Waterbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/341,839

(22) Filed: Dec. 22, 2008

(65) Prior Publication Data

US 2009/0160118 A1 Jun. 25, 2009

Related U.S. Application Data

(60) Provisional application No. 61/015,872, filed on Dec. 21, 2007.

(51) Int. Cl.
*B65H 5/00* (2006.01)
*B65H 3/52* (2006.01)

(52) U.S. Cl. ..... 271/10.01; 271/104; 271/121; 271/124

(58) Field of Classification Search ..... 271/10.01, 271/104, 121, 122, 124, 125
See application file for complete search history.

(56) References Cited

U.S. PATENT DOCUMENTS 4,451,027 A * 5/1984 Alper ..... 271/10.02
7,036,815 B2 * 5/2006 Yamamoto ..... 271/124
7,052,008 B2 * 5/2006 Mitsuya et al. ..... 271/122
7,392,980 B2 * 7/2008 Takeuchi et al. ..... 271/125
7,429,040 B2 * 9/2008 Ueda et al. ..... 271/122
2004/0188916 A1 * 9/2004 Tsukamoto et al. ..... 271/110
2006/0017216 A1 * 1/2006 Mitsuya et al. ..... 271/121
2006/0180990 A1 * 8/2006 Ueda et al. ..... 271/121
2007/0126171 A1 * 6/2007 Takeuchi et al. ..... 271/121

* cited by examiner

*Primary Examiner*—David H Bollinger
(74) *Attorney, Agent, or Firm*—Christopher H. Kirkman; Angelo N. Chaclas

(57) ABSTRACT

A method of transporting items includes receiving a group of one or more items in a singulation device, implementing a singulation routine, measuring a speed of a first portion of the group, measuring a speed of a second portion of the group, and comparing the speed of the first portion with the speed of the second portion. The method may further include continuing the singulation routine where the speed of the first portion is not equal to the speed of the second portion, and terminating the singulation routine where the speed of the first portion is equal to the speed of the second portion. The method may also include transporting a lead item away from the singulation device. The singulation device may include opposing transport elements.

18 Claims, 4 Drawing Sheets

ITEM TRANSPORT WITH SINGULATION DETECTION

CROSS REFERENCE TO RELATED APPLICATIONS

The benefit of priority is claimed under 35 U.S.C. 119(e) of U.S. Provisional Patent Application No. 61/015,872 filed Dec. 21, 2007, entitled "SINGULATION DETECTION IN MIXED MAIL FEEDER," which is incorporated by reference herein in its entirety.

FIELD OF THE INVENTION

The present invention relates to an item transport and, more particularly, to an item transport that detects singulation of items.

BACKGROUND OF THE INVENTION

Item transport systems, such as mailpiece handling systems, for example, are known in the art. These systems include inserter systems, which create mailpieces and prepare them for mailing, as well as sortation systems, which sort completed mailpieces and direct the mailpieces to storage pockets or bins, depending on the system's configuration. Sortation of mailpieces may be carried out either prior to mailing (i.e., outsorting) or upon receipt from a postal carrier (i.e., insorting). Other types of transport systems and related applications are known.

In some mailpiece handling systems, mailpieces are transported using belts or chain drives between stations where they undergo various types of processing. The processing may include cutting, folding, scanning, weighing, printing, and labeling, for example.

Some systems are configured to process mailpieces of different sizes and/or different types. In one example, a mailpiece handling system may be configured to process envelopes of different sizes. Other systems may be configured to process different types of mailpieces, such as envelopes, postcards, magazines, and catalogs, for example.

Many of the processing steps implemented by mailpiece handling systems require precise spacing between mailpieces and orientation of the respective mailpieces. Control of the mailpieces may be applied at various points in a typical mailpiece handling system, including at the infeed portion, as well as on the transports that move mailpieces between the various processing stations.

Difficulties with mailpiece control may be encountered in systems that handle mailpieces of different sizes and/or different types, as discussed above. In a further complicating factor, the various items may be provided with different wrapping materials, ranging from no wrapping material in the case of envelopes to polymer coverings in the case of magazines, for example. These difficulties add to the complexity of mailpiece handling systems and decrease their reliability.

Complex handling methods may be utilized to provide control of mailpieces where these difficulties exist. To improve the operating efficiency of such systems, however, it may be desirable to minimize the duration of complex handling functions where possible.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a method of transporting items comprising receiving a group of one or more items in a singulation device, implementing a singulation routine, measuring a speed of a first portion of the group, measuring a speed of a second portion of the group, and comparing the speed of the first portion with the speed of the second portion. In some embodiments, the singulation device comprising opposing transport elements. The method may further include continuing the singulation routine where the speed of the first portion is not equal to the speed of the second portion, terminating the singulation routine where the speed of the first portion is equal to the speed of the second portion, and transporting a lead item away from the singulation device.

As used herein, "items" include papers, documents, postcards, envelopes, brochures, enclosures, booklets, magazines, media items, including CDs, DVDs, computer disks, and/or other digital storage media, and packages having a range of sizes and materials. The items may be unwrapped or may be covered with a wrapping material such as paper, a polymer wrap, such as polyethylene, for example, or other wrapping material.

Further, as used herein, "singulate" means separate along the transport path so that the items have no overlapping portion. "Singulation device" means a device configured to singulate items.

In another aspect, the invention relates to an item transport comprising a singulation device for receiving a group of one or more items, the singulation device comprising opposing transport elements, and a controller operatively connected to the transport elements. The controller may be configured to implement a singulation routine, measure a speed of a first portion of the group, measure a speed of a second portion of the group, compare the speed of the first portion with the speed of the second portion, continue the singulation routine where the speed of the first portion is not equal to the speed of the second portion, terminate the singulation routine where the speed of the first portion is equal to the speed of the second portion, and activate a transport nip to transport a lead item away from the singulation device.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the method according to the invention are described with reference to certain applications in mailpiece sortation systems. It should be understood, however, that the method of the invention may be used in association with other systems configured to handle and transport items. Further, many sortation systems are modular and may include more or fewer modules than those described herein based on the particular application.

Figure 1:
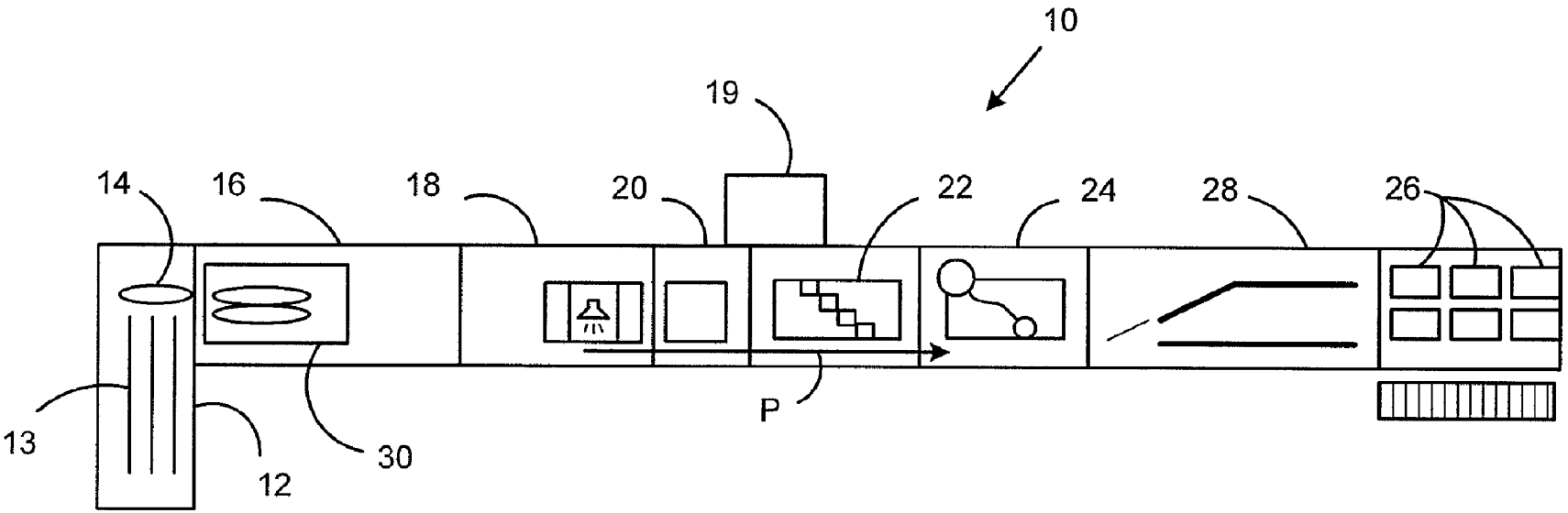
FIG. 1 is a block diagram of a sortation system utilizing an embodiment of the item transport according to the invention.

A sortation system 10 incorporating an embodiment of the item transport of the invention is shown in FIG. 1. The illustrated sortation system 10 may be used to carry out embodiments of the method of the invention described below.

The sortation system 10 includes a feeder module 12 for feeding items for sortation. In one embodiment, the items are arranged on the feeder on edge and advanced using a conveyor 13, for example, towards a feeder belt 14, shown schematically in FIG. 1. Other feeding arrangements may also be used.

In this embodiment, the feeder belt 14 is configured to contact a surface of an approaching item and to redirect the item's direction of travel substantially perpendicularly to advance the item for downstream processing. The feeder belt 14 may feed a single item at a time. Often, however, contact between items causes multiple items to advance. The multiple items may be overlapping to various degrees.

From the feeder module 12, the items are fed to a singulation module 16, which singulates the overlapping items to ensure that only one item at a time is processed by the system. The singulated items are fed along a transport path P for processing by various modules. As discussed above, many item processing systems, such as mailpiece handling systems, for example, optimally process items that are spaced apart at a predetermined pitch.

As used herein, "pitch" means the distance along the transport path from the leading edge of a downstream item (e.g., the lead item) to the leading edge of an upstream item (e.g., the subsequent item). Thus, pitch includes the length of an item and the space between that item and a subsequent item. In one embodiment, the sortation system 10 utilizes a pitch of approximately 29 inches. Other pitches may also be used. In some embodiments, the pitch may be varied.

The items first pass through a scanning module 18, where an image of at least a portion of each item is obtained. The scanned image may be used by the controller 19 to determine the destination pocket for the item. As discussed above, bins may also be used, depending on the configuration of the sortation system. In the illustrated sortation system 10, the items then pass through a weighing module 20, where the weight of the item is obtained.

In some applications, a sortation system is used to apply markings, such as an address or code, for example, to the face of items being processed. Such markings may be added using a printer or labeler. Both a printing module 22 and a labeling module 24 are included in the illustrated sortation system 10.

Finally, the items are directed to the destination pocket 26 using a diverter module 28 in the transport path P. For systems with pockets 26 on multiple levels, an elevator arrangement (not shown) may be used to move the items to the appropriate level.

The singulation module 16 of the sortation system 10 comprises an item transport 30, which implements a method of transporting items according to embodiments of the invention and feeds singulated items along the transport path P at a predetermined pitch for processing by the other modules of the system 10.

Figure 2:
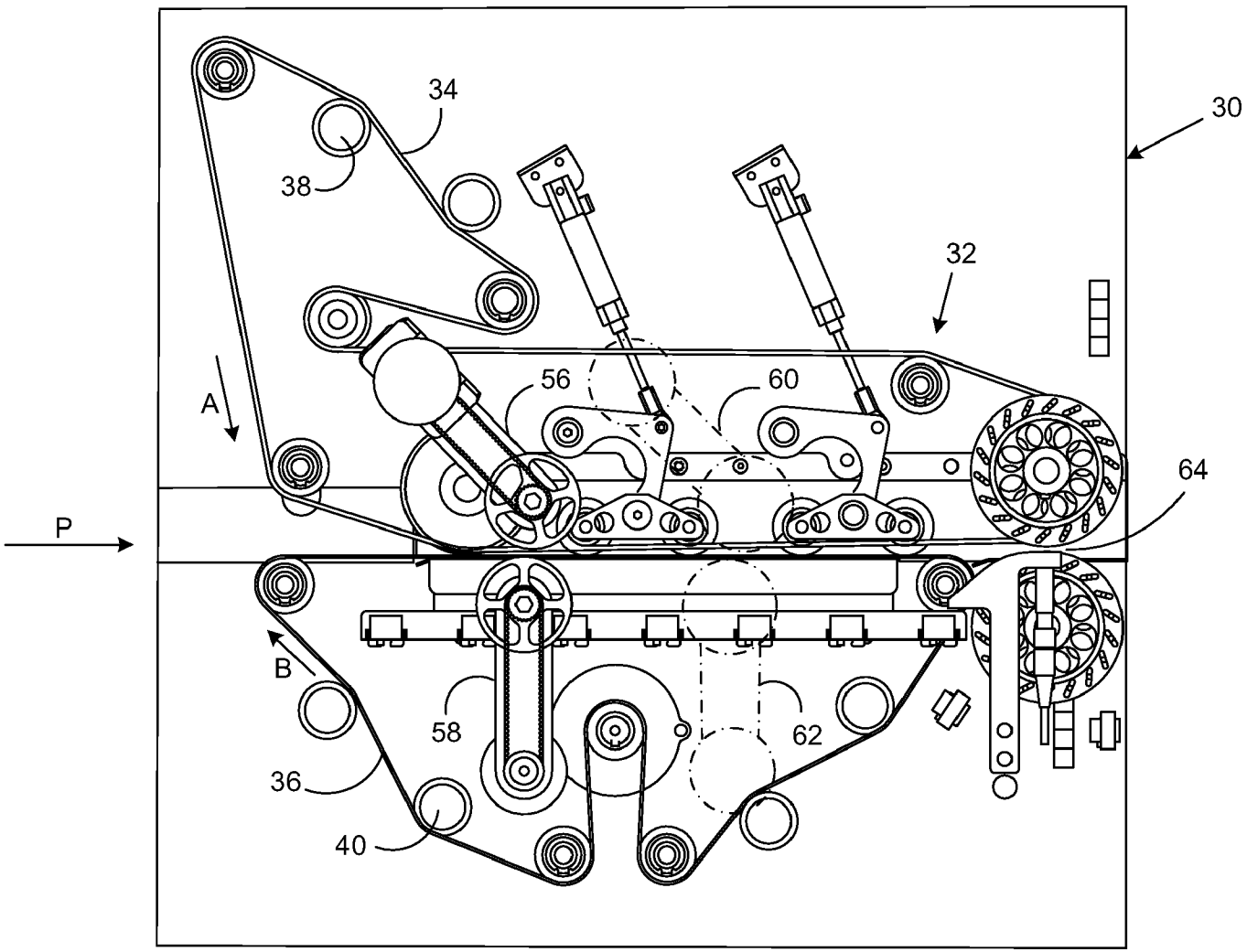
FIG. 2 is a plan view of an embodiment of the item transport according to the invention.

An embodiment of the item transport 30 is shown in FIG. 2. As shown, the illustrated item transport 30 comprises a singulation device 32 for receiving a group of one or more items. Thus, the term "group" may refer to a single item. Alternatively, "group" may refer to two or more items.

The singulation device 32 shown in FIG. 2 comprises opposing transport elements. In one embodiment, the opposing transport elements comprise a first transport element 34 configured for rotation in a first direction, indicated at arrow A in FIG. 2, and a second transport element 36 in opposing relation to the first transport element. The second transport element 36 is configured for rotation in a second direction, indicated at arrow B in FIG. 2, opposite to the first direction.

In the illustrated embodiment, the first transport element 34 comprises a single flat belt disposed on a plurality of smooth first transport rollers 38. Alternatively, the first transport element may comprise a plurality of belts, for example. In further embodiments, the first transport element may comprise O-rings driven with rollers, toothed belts driven with pulleys, chains driven with sprockets, or other drive combinations.

Similarly, the illustrated second transport element 36 comprises a single flat belt disposed on a plurality of smooth second transport rollers 40. Alternatively, the second transport element may comprise a plurality of belts or other drive combinations, as discussed above.

The item transport 30 further comprises a controller 19 (shown in FIG. 1) operatively connected to the transport elements 34, 36. In one example, the controller 19 comprises a programmable logic controller. Other types of controller hardware may also be used. In addition, the location of the controller 19 shown in FIG. 1 is exemplary only. The controller 19 may be located essentially anywhere relative to the sortation system 10, provided that it is operatively connected to the appropriate components of the item transport 30.

The controller 19 is configured to implement a singulation routine in the item transport 30. In one embodiment, to implement the singulation routine, the controller 19 is configured to rotate the first transport element 34 at a first transport speed and to rotate the second transport element 36 at a second transport speed substantially equal to the first transport speed. The first transport speed and the second transport speed comprise a conveying speed. Rotating the first transport element 34 and the second transport element 36 at the conveying speed conveys the group between the transport elements along a transport path P. The controller 19 is further configured to decrease the second transport speed, whereby overlapping items are singulated.

Figure 3:
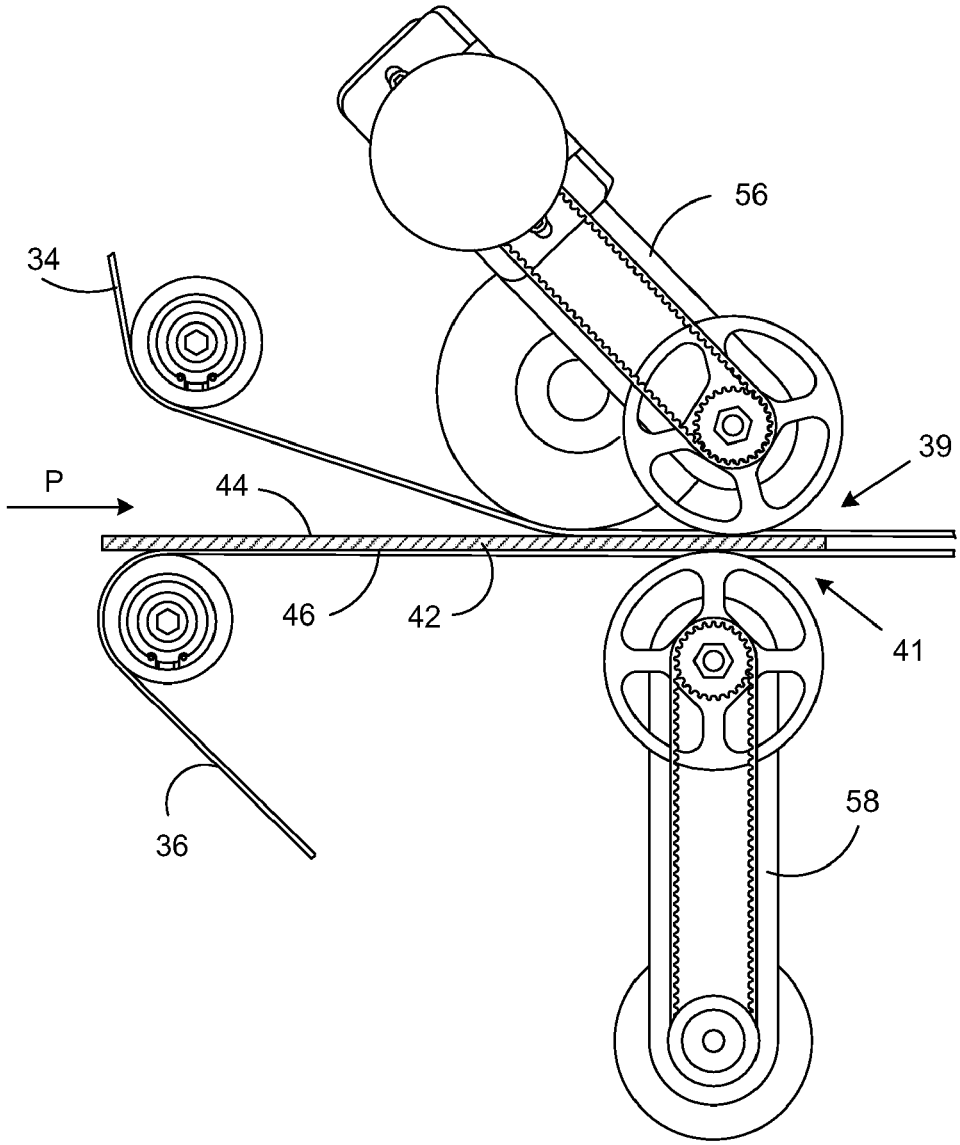
FIG. 3 is a partial schematic view of the item transport of FIG. 2 illustrating an embodiment of the method according to the invention.
Figure 4:
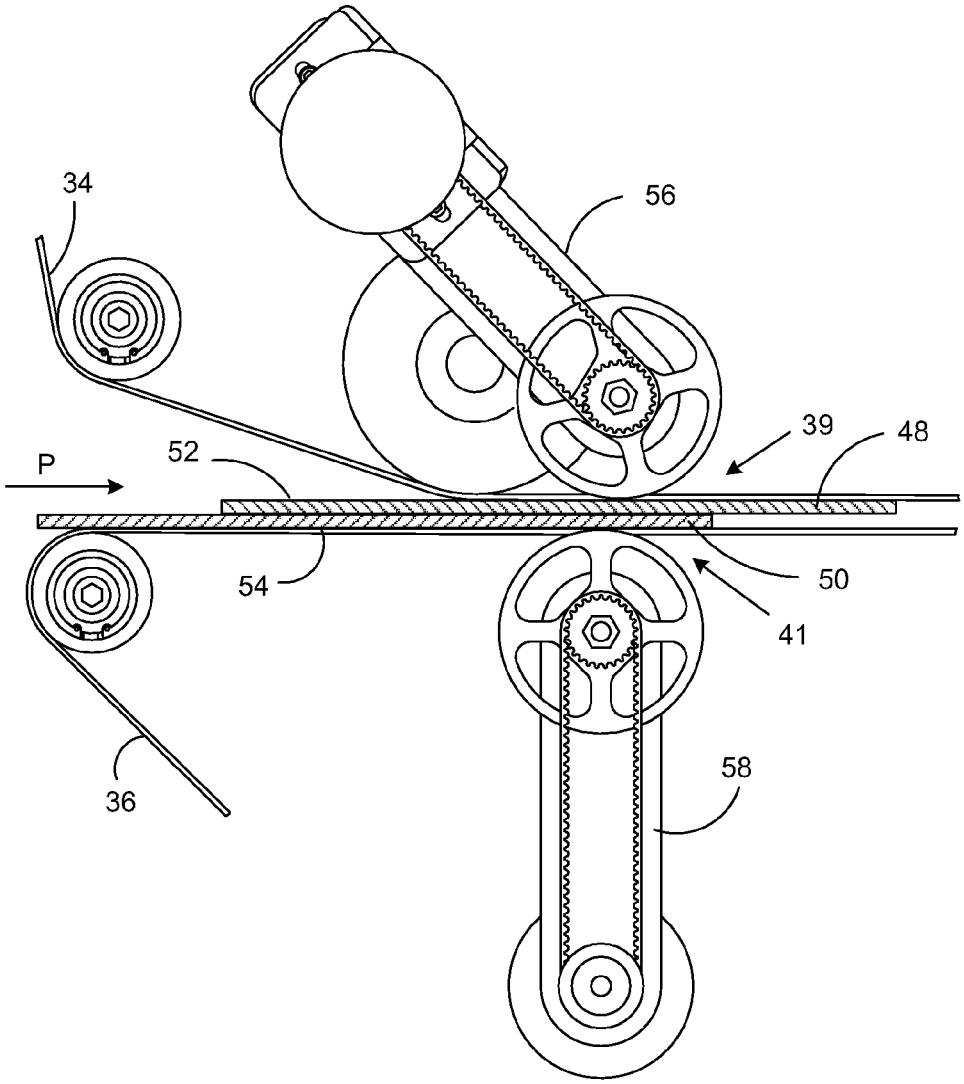
FIG. 4 is a partial schematic view of the item transport of FIG. 2 illustrating another embodiment of the method according to the invention.

The controller 19 is further configured to measure a speed of a first portion 39 of the group and to measure a speed of a second portion 41 of the group, shown in FIGS. 3 and 4. In one embodiment, the first portion 39 of the group comprises a first side of the group, and the second portion 41 of the group comprises a second side of the group. Where the group comprises a single item 42, as shown in FIG. 3, the first side 44 of the group comprises the first side of the single item 42, which faces the first transport element 34. The second side 46 of the group comprises the second side of the single item 42, which faces the second transport element 36.

In another example, the group comprises two or more items. A group comprising two items 48, 50 is shown in FIG. 4. As shown, a first item 48 is adjacent to the first transport element 34 and a second item 50 is adjacent to the second transport element 36. Additional items in a group may be disposed between the first item 48 and the second item 50. In the illustrated arrangement, the first side 52 of the group comprises the side of the first item 48 adjacent to the first transport element 34 and the second side 54 of the group comprises the side of the second item 50 adjacent to the second transport element 36.

In one embodiment, to measure the speed of the first portion 39 the controller 19 is configured to receive a signal from a first detector 56 engaging the first side 44, 52. Further, to measure the speed of the second portion 41 the controller 19 is configured to receive a signal from a second detector 58 engaging the second side 46, 54, as shown in FIGS. 2-4. In the illustrated embodiment, the first detector 56 and the second detector 58 comprise rotary encoders. Other detectors may also be used.

In the illustrated embodiment, the first detector 56 is movably mounted with respect to the transport elements 34, 36 and biased into contact with items being conveyed on the transport path P. The second detector 58 is fixedly mounted. Other arrangements may also be used.

The controller 19 is further configured to compare the speed of the first portion 39 with the speed of the second portion 41. In the example where the group comprises a single item 42, as shown in FIG. 3, the first detector 56 and the second detector 58 measure the speed of opposite sides of the same item. Of course, in that case the speed of the first side 44 of the single item 42 is the same as the speed of the second side 46 of the item 42. Thus, the speed of the first portion 39 is equal to the speed of the second portion 41.

The controller 19 is configured to terminate the singulation routine where the speed of the first portion 39 is equal to the speed of the second portion 41. In one embodiment, to terminate the singulation routine, the controller 19 is configured to increase the second transport speed to the conveying speed. Thus, where singulation has already occurred, the first transport element 34 and the second transport element 36 may be operated at the conveying speed. Accordingly, the item is moved through the item transport 30 more quickly, allowing the item transport 30 and, therefore, the sortation system 10 to process items in a more efficient manner.

In the example where the group comprises two or more items, as shown in FIG. 4, the first detector 56 and the second detector 58 measure the speeds of opposing faces of different items (e.g., the first item 48 and the second item 50). When the singulation routine is implemented, the second transport speed is decreased and the overlapping items 48, 50 are singulated, as shown in FIG. 4.

As the items are singulated, the first item 48 continues to advance with the first transport element 34 along the transport path P, while the second item 50 begins to slow down with the second transport element 36. In that case, the speed of the first side 52 of the first item 48 is greater than the speed of the second side 54 of the second item 50. Thus, the speed of the first portion 39 is not equal to the speed of the second portion 41.

The controller 19 is configured to continue the singulation routine where the speed of the first portion 39 is not equal to the speed of the second portion 41. Accordingly, the first transport element 34 is maintained at the conveying speed and the second transport speed is further decreased to complete the singulation of the first item 48. Thus, the singulation routine is maintained only when singulation has not yet been completed.

In a further embodiment, after the singulation routine is continued, the controller 19 is further configured to measure a second speed of the first portion 39 of the group, measure a second speed of the second portion 41 of the group, and compare the second speed of the first portion 39 with the second speed of the second portion 41. The additional measurement is carried out using a third detector 60 and fourth detector 62, shown in FIG. 2 in dashed lines.

In that embodiment, the controller 19 is further configured to continue the singulation routine where the second speed of the first portion 39 is not equal to the second speed of the second portion 41 and to terminate the singulation routine where the second speed of the first portion 39 is equal to the second speed of the second portion 41. The additional singulation detection may further increase the operational efficiency of the item transport 30 and, therefore, of the sortation system 10.

Once singulation has occurred, the controller 19 is configured to activate a transport nip 64, shown in FIG. 2, to transport a lead item away from the singulation device 32.

In one embodiment, the controller 19 is further configured to decrease the first transport speed prior to transporting the lead item away from the singulation device 32. The first transport speed is reduced in order to position the lead item at the transport nip 64 in order to maintain a desired pitch between consecutive items.

In operation, the singulation device 32 receives a group of one or more items. The singulation device 32 is shown processing a single item 42 in FIG. 3 and two items 48, 50 in FIG. 4. In the embodiment shown in FIG. 2, the singulation device comprises opposing transport elements. In some embodiments, the opposing transport elements comprise a first transport element 34 configured for rotation in a first direction (counterclockwise as seen in FIG. 2) and a second transport element 36 in opposing relation to the first transport element 34. The second transport element 36 is configured for rotation in a second direction (clockwise in FIG. 2) opposite to the first direction.

Next, a singulation routine is implemented. In one embodiment, implementing the singulation routine comprises rotating the first transport element 34 at a first transport speed (e.g., conveying speed), rotating the second transport element 36 at a second transport speed substantially equal to the first transport speed, conveying the group between the transport elements along a transport path P, and decreasing the second transport speed, whereby overlapping items are singulated. Two items 48, 50 undergoing singulation are shown in FIG. 3.

Next, a speed of a first portion 39 of the group is measured, a speed of a second portion 41 of the group is measured, and the speed of the first portion 39 is compared with the speed of the second portion 41. As discussed above, the first portion 39 of the group comprises a first side of the group and the second portion 41 of the group comprises a second side of the group.

In one embodiment, measuring the speed of the first portion 39 comprises engaging the first side with a first detector 56, and measuring the speed of the second portion 41 comprises engaging the second side with a second detector 58. In the illustrated embodiment, the first detector 56 and the second detector 58 comprise rotary encoders.

The system proceeds based on the comparison of the speed of the first portion 39 and the second portion 41. In a first case, the singulation routine is continued where the speed of the first portion 39 is not equal to the speed of the second portion 41. The measuring and comparison of the speeds of the first and second portions may be repeated after the singulation routine is continued.

In a second case, the singulation routine is terminated where the speed of the first portion 39 is equal to the speed of the second portion 41. In one example, terminating the singulation routine comprises increasing the second transport speed to the conveying speed.

Finally, once singulation has been completed, a lead item is transported away from the singulation device 32. In one embodiment, the first transport speed is decreased prior to transporting the lead item away from the singulation device 32.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of transporting items, comprising:

receiving a group of one or more items in a singulation device, the singulation device comprising opposing transport elements;

implementing a singulation routine;

measuring a speed of a first portion of the group;

measuring a speed of a second portion of the group;

comparing the speed of the first portion with the speed of the second portion;

continuing the singulation routine where the speed of the first portion is not equal to the speed of the second portion;

terminating the singulation routine where the speed of the first portion is equal to the speed of the second portion; and transporting a lead item away from the singulation device.

2. The method of claim 1, wherein the opposing transport elements comprise:

a first transport element configured for rotation in a first direction; and a second transport element in opposing relation to the first transport element, wherein the second transport element is configured for rotation in a second direction opposite to the first direction.

3. The method of claim 2, wherein implementing the singulation routine comprises:

rotating the first transport element at a first transport speed;

rotating the second transport element at a second transport speed substantially equal to the first transport speed, wherein the first transport speed and the second transport speed comprise a conveying speed;

conveying the group between the transport elements along a transport path; and decreasing the second transport speed, whereby overlapping items are singulated.

4. The method of claim 3, wherein terminating the singulation routine comprises increasing the second transport speed to the conveying speed.

5. The method of claim 3, further comprising decreasing the first transport speed prior to transporting the lead item away from the singulation device.

6. The method of claim 1, wherein the first portion of the group comprises a first side of the group, and wherein the second portion of the group comprises a second side of the group.

7. The method of claim 6, wherein measuring the speed of the first portion comprises receiving a signal from a first detector engaging the first side, and wherein measuring the speed of the second portion comprises receiving a signal from a second detector engaging the second side.

8. The method of claim 7, wherein the first detector and the second detector comprise rotary encoders.

9. The method of claim 1, further comprising, after continuing the singulation routine:

measuring a second speed of the first portion of the group;

measuring a second speed of the second portion of the group;

comparing the second speed of the first portion with the second speed of the second portion;

further continuing the singulation routine where the second speed of the first portion is not equal to the second speed of the second portion; and terminating the singulation routine where the second speed of the first portion is equal to the second speed of the second portion.

10. An item transport, comprising:

a singulation device for receiving a group of one or more items, the singulation device comprising opposing transport elements; and a controller operatively connected to the transport elements, the controller configured to:

implement a singulation routine;

measure a speed of a first portion of the group;

measure a speed of a second portion of the group;

compare the speed of the first portion with the speed of the second portion;

continue the singulation routine where the speed of the first portion is not equal to the speed of the second portion;

terminate the singulation routine where the speed of the first portion is equal to the speed of the second portion; and activate a transport nip to transport a lead item away from the singulation device.

11. The item transport of claim 10, wherein the opposing transport elements comprise:

a first transport element configured for rotation in a first direction; and a second transport element in opposing relation to the first transport element, wherein the second transport element is configured for rotation in a second direction opposite to the first direction.

12. The item transport of claim 11, wherein to implement the singulation routine, the controller is configured to:

rotate the first transport element at a first transport speed;

rotate the second transport element at a second transport speed substantially equal to the first transport speed, wherein the first transport speed and the second transport speed comprise a conveying speed, so as to convey the group between the transport elements along a transport path; and decrease the second transport speed, whereby overlapping items are singulated.

13. The item transport of claim 12, wherein to terminate the singulation routine, the controller is configured to increase the second transport speed to the conveying speed.

14. The item transport of claim 12, wherein the controller is further configured to decrease the first transport speed prior to transporting the lead item away from the singulation device.

15. The item transport of claim 10, wherein the first portion of the group comprises a first side of the group, and wherein the second portion of the group comprises a second side of the group.

16. The item transport of claim 15, wherein to measure the speed of the first portion the controller is configured to receive a signal from a first detector engaging the first side, and wherein to measure the speed of the second portion the controller is configured to receive a signal from a second detector engaging the second side.

17. The item transport of claim 16, wherein the first detector and the second detector comprise rotary encoders.

18. The item transport of claim 10, wherein the controller is further configured, after the singulation routine is continued, to:

measure a second speed of the first portion of the group;

measure a second speed of the second portion of the group;

compare the second speed of the first portion with the second speed of the second portion;

further continue the singulation routine where the second speed of the first portion is not equal to the second speed of the second portion; and terminate the singulation routine where the second speed of the first portion is equal to the second speed of the second portion.

* * * * *